United States Patent [19]

Mabe et al.

[11] Patent Number: 4,547,138

[45] Date of Patent: Oct. 15, 1985

[54] LUBRICATING MECHANISM FOR SCROLL-TYPE FLUID DISPLACEMENT APPARATUS

[75] Inventors: Atsushi Mabe; Shigemi Shimizu; Akihiro Kawano, all of Gunma, Japan

[73] Assignee: Sanden Corporation, Gunma, Japan

[21] Appl. No.: 589,755

[22] Filed: Mar. 15, 1984

[30] Foreign Application Priority Data

Mar. 15, 1983 [JP] Japan ..... 58-36342[U]
Mar. 15, 1983 [JP] Japan ..... 58-36343[U]

[51] Int. Cl.[4] ..... F01C 1/04; F01C 21/04

[52] U.S. Cl. ..... 418/55; 418/91; 418/94; 418/100

[58] Field of Search ..... 418/55, 91, 94, 100, 418/102

[56] References Cited

U.S. PATENT DOCUMENTS 801,182 10/1905 Creux ..... 418/55
4,314,796 2/1982 Terauchi ..... 418/55
4,332,535 6/1982 Terauchi et al. ..... 418/55
4,340,339 7/1982 Hiraga et al. ..... 418/55
4,343,599 8/1982 Kousokabe ..... 418/55
4,470,778 9/1984 Mabe ..... 418/55

FOREIGN PATENT DOCUMENTS 54-139107 10/1979 Japan ..... 418/55
56-156490 12/1981 Japan ..... 418/55

*Primary Examiner*—John J. Vrablik
*Attorney, Agent, or Firm*—Banner, Birch, McKie & Beckett

[57] ABSTRACT

A lubricating mechanism for a scroll-type fluid displacement apparatus is disclosed. A driving mechanism for an orbiting scroll comprises a drive shaft and a drive pin projecting at an eccentric location from an inner end surface of the drive shaft. An annular boss projecting from a circular end plate of the orbiting scroll receives the drive pin. Therefore, the orbiting scroll is rotatably supported on the drive pin. The lubricating mechanism includes an oil passageway formed in the circular end plate of the orbiting scroll to communicate between the interior of the boss and one of the fluid packets located at the outer peripheral portion of the spiral elements. Lubricating oil thus flows into the interior of the boss and lubricates the bearing and other contact surface disposed in the center portion of the apparatus.

4 Claims, 2 Drawing Figures

LUBRICATING MECHANISM FOR SCROLL-TYPE FLUID DISPLACEMENT APPARATUS

TECHNICAL FIELD

This invention relates to a fluid displacement apparatus, and more particularly, to a mechanism for lubricating a portion of the driving mechanism of a scroll-type fluid displacement apparatus.

BACKGROUND OF THE INVENTION

Scroll-type fluid displacement apparatus are well-known in the prior art. For example, U.S. Pat. No. 801,182 (Creux) discloses the basic construction of a scroll-type fluid displacement apparatus which includes two scroll members, each having a circular end plate and a spiroidal or involute spiral element. These scroll members are maintained angularly and radially offset so that the spiral elements interfit to make a plurality of line contacts between their spiral curved surfaces which define and seal off at least one pair of fluid pockets. The relative orbital motion of the two scroll members shifts the line contacts along the spiral curved surface, thus changing the volume of fluid pockets. Since the volume of fluid pockets increases or decreases dependent on the direction of the orbital motion, the scroll-type fluid displacement apparatus is applicable to compress, expand or pump fluids.

In a conventional refrigerant compressor, a charge of refrigerant fluid and lubricating oil is introduced in to the area of the fluid pockets. The fluid is compressed by the orbital motion of scroll member and the compressed fluid is fed out of the compressor. The lubricating oil splashes up in the interior of the compressor housing to lubricate desired components of the compressor. The splashed lubricating oil mixes with the fluid, and the fluid fills the interior of the compressor housing to thereby lubricate the moving parts of the compressor. However, if only the splashed oil or oil-fluid mixture is used for lubrication, lubrication of the driving mechanism and other components which are located in the center portion of the compressor is insufficient, because the splashed oil and the fluid are forced outwardly by the centrifugal force of the moving parts.

One solution to the above-discussed disadvantage is described in U.S. Pat. No. 4,314,796. In this apparatus, the driving mechanism for the orbiting scroll comprises a drive shaft and a drive pin eccentrically projecting from the inner end surface of the drive shaft. The drive pin is fitted within a boss projecting from the end surface of the circular end plate through a bearing so that the orbiting scroll is driven by the rotation of the drive shaft. In this construction, the bearing disposed on the drive pin is lubricated by the lubricating oil which flows from a shaft seal cavity through a passageway formed in the drive shaft and drive pin. Since the lubricating oil is supplied to the boss portion from the shaft seal cavity by a difference of centrifugal force, the lubrication to the bearing can be insufficient. In order to increase the flow of oil from the shaft seal cavity to the boss portion, the eccentric throw of the drive pin must be increased so that the diameter of the compressor is increased.

SUMMARY OF THE INVENTION

It is a primary object of this invention to provide an improvement in a fluid displacement apparatus, in particular a compressor unit of the scroll type which has an effective and simple lubricating mechanism.

It is another object of this invention to provide a fluid displacement apparatus, in particular a compressor unit of the scroll type, wherein moving parts are effectively lubricated by the lubrication oil supplied through the improved lubricating mechanism.

It is still another object of this invention to provide a fluid displacement apparatus, in particular a compressor unit of the scroll type, which is simple in construction and achieves the above-described objects.

A scroll-type fluid displacement apparatus according to this invention includes a housing having a front end plate. A fixed scroll is fixedly disposed relative to the housing and has a first circular end plate from which a first wrap extends. An orbiting scroll has a second circular end plate from which a second wrap extends. The first and second wraps interfit at an angular and radial offset to make a plurality of line contacts which define at least one pair of sealed-off fluid pockets. A driving mechanism is operatively connected to the orbiting member to effect the orbital motion of the orbiting scroll. As the orbital scroll orbits, the line contacts shift toward the center portion or outer portion of the wraps, so that the volume of the fluid pockets changes.

The driving mechanism comprises a drive shaft rotatably supported by the front end plate and a drive pin projecting at an eccentric location from the inner end of the drive shaft. The second end plate of the orbiting scroll has an annular boss projecting from the side surface thereof opposite the side from which the wrap extends. The drive pin is disposed within the annular boss through at least a bearing to support the orbiting scroll. An oil passageway is formed in the second end plate and communicates between the interior of the annular boss and a fluid pocket located at the outer peripheral portion of the wraps. The lubricating oil is therefore supplied to the interior of the boss from the outer peripheral portion of the interior of the housing to lubricate the supporting portion of the orbiting scroll.

Further objects, features, and other aspects of this invention will be understood from the following detailed description of preferred embodiments of this invention, referring to the annexed drawings.

DETAILED DESCRIPTION OF THE PREFERRED EMBODIMENTS

Figure 1:
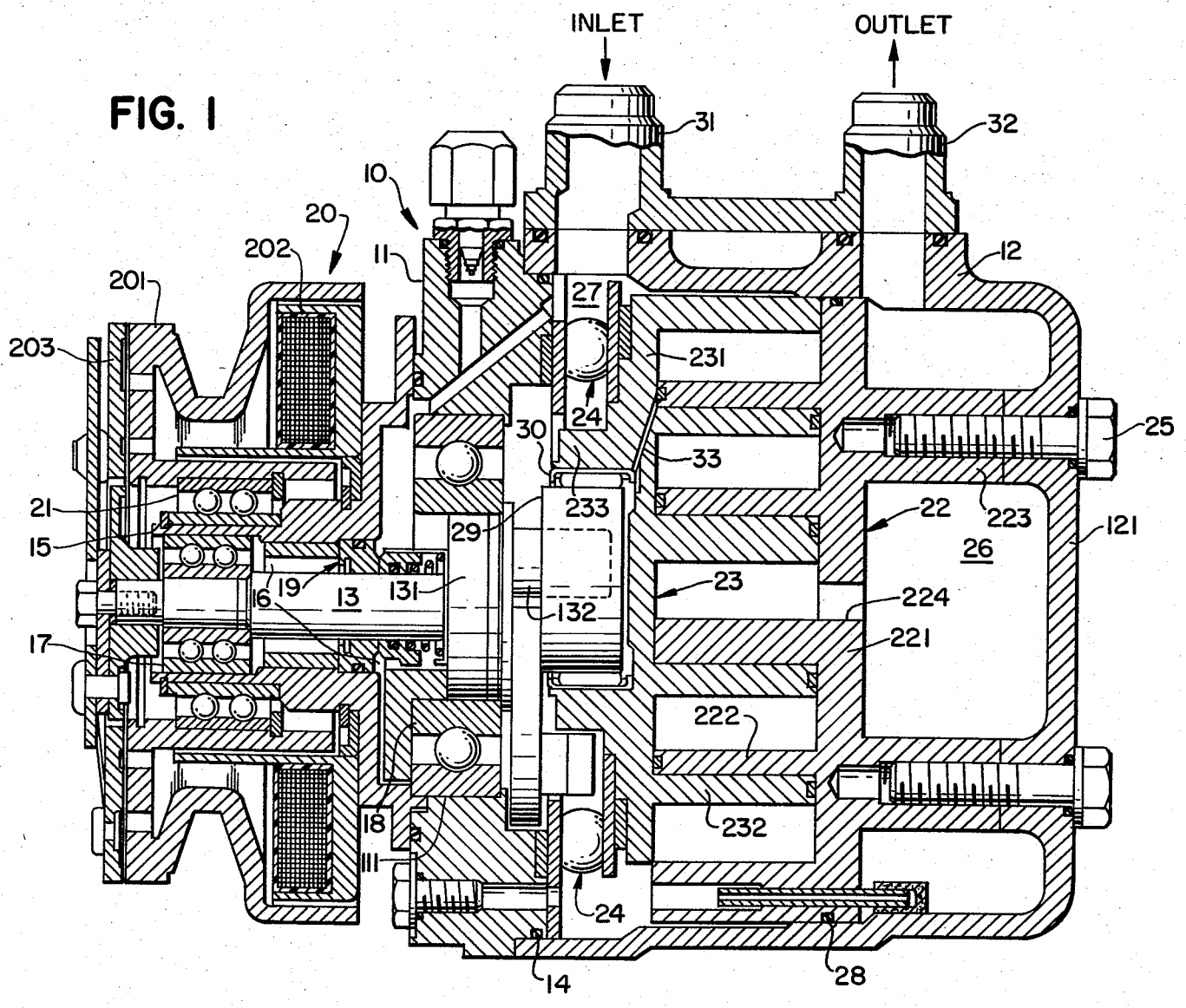
FIG. 1 is a vertical sectional view of a compressor unit according to one embodiment of this invention.

In FIG. 1, a fluid displacement apparatus in accordance with the present invention, in particular, one embodiment of a scroll-type refrigerant compressor unit is shown. The compressor unit includes a housing 10 which comprises a front end plate 11 and a cup-shaped casing 12 which is fastened to the rear end surface of front end plate 11 by suitable, conventional fasteners. The opening portion of cup-shaped casing 12 is thus covered by front end plate 11. The mating surface between front end plate 11 and cup-shaped casing 12 is sealed off by an O-ring 14. An opening 111 is formed in the center of front end plate 11 for the penetration or passage of a drive shaft 13. Front end plate 11 has an annular sleeve 15 projecting axially outward from its front end surface. Sleeve 15 surrounds drive shaft 13 to define a shaft seal cavity 16.

Drive shaft 13 is rotatably supported by sleeve 15 through a bearing 17 located within the front end of sleeve 15. Drive shaft 13 has a disk-shaped rotor 131 at its inner end. Disk-shaped rotor 131 is rotatably supported by front end plate 11 through a bearing 18 located within opening 111 of front end plate 11. A shaft seal assembly 19 is assembled on drive shaft 13 within shaft seal cavity 16 of sleeve 15.

An electromagnetic clutch 20, which is disposed around sleeve 15, comprises a pulley 201 rotatably supported on sleeve 15 through a bearing 21, an electromagnetic coil 202 disposed within an annular cavity of pulley 201, and an armature plate 203 fixed on the outer end of drive shaft 13. The pulley 201 is connected with an external power source to transmit rotating motion to drive shaft 13. Thus, drive shaft 13 is driven by the external power source through magnetic clutch 20.

A number of elements are located within the inner chamber of cup-shaped casing 12 including a fixed scroll 22, an orbiting scroll 23, a driving mechanism for orbiting scroll 23 and a rotation-preventing/thrust-bearing device 24 for orbiting scroll 23. The inner chamber is formed between the inner wall of cup-shaped casing 12 and the rear end surface of front end plate 11.

Fixed scroll 22 includes a circular end plate 221, a wrap or spiral element 222 affixed to or extending from one side surface of circular end plate 221, and a plurality of internally threaded bosses 223 axially projecting from the other end surface of circular end plate 221. An axial end surface of each boss 223 is seated on the inner surface of an end plate 121 of cup-shaped casing 12 and is fixed to end plate 121 by bolts 25. Scroll 22 is thus fixed within cup-shaped casing 12. Circular end plate 221 of fixed scroll 22 divides the inner chamber of cup-shaped casing 12 into a discharge chamber 26 having bosses 223, and a suction chamber 27 in which spiral element 222 of fixed scroll 22 is located. A seal ring 28 placed between the outer peripheral surface of circular end plate 221 and the inner wall of cup-shaped casing 12. A hole or discharge port 224 is formed through circular end plate 221 at a position near the center of spiral element 222. Hole 224 is connected between the fluid pocket at the spiral element's center and discharge chamber 26.

Orbiting scroll 23, which is located in suction chamber 27, also includes a circular end plate 231 and a wrap or spiral element 232 affixed to or extending from one side surface of circular end plate 231. Spiral elements 222 and 232 interfit at angular offset of 180° and predetermined radial offset. At least a pair of sealed-off fluid pockets are thereby defined between spiral elements 222 and 232. Orbiting scroll 23 has a boss 233 axially projecting from the other side of circular end plate 231, and is rotatably supported on a bushing 29 disposed within boss 233 through a bearing 30. Also, bushing 29 is rotatably supported on a drive pin 132 projecting at an eccentric location from the inner end of disk-shaped rotor 131. Orbiting scroll 23 is thus rotatably supported on drive pin 132 and driven by the rotation of drive shaft 13. The rotation of orbiting scroll 23 is prevented by a rotation-preventing/thrust-bearing device 24 placed between the inner end surface of front end plate 11 and the end surface of circular end plate 231, so that orbiting scroll 23 undergoes the orbital motion upon rotation of drive shaft 13.

As the orbiting scroll 23 orbits, the line contacts between spiral elements 222 and 232 shift toward the center of the spiral elements along the surfaces of the spiral elements. The fluid pockets defined by the line contacts between elements 222 and 232 move toward the center with a consequent reduction of volume to thereby compress the fluid in the fluid pockets. Therefore, fluid or refrigerant gas introduced into suction chamber 27 from an external fluid circuit through an inlet port 31 mounted on the outside of cup-shaped casing 12 is taken into the fluid pockets formed at the outer portion of spiral elements 222 and 232. As orbiting scroll 23 orbits, the fluid in fluid pockets is compressed as the pockets move toward the center of the spiral element. Finally, the compressed fluid is discharged into discharge chamber 26 through hole 224 and, therefrom, the fluid is discharged to the external fluid circuit through an outlet port 32 formed on cup-shaped casing 12.

In the above-described construction, an oil passageway 33 is formed through circular end plate 231 of orbiting scroll 23, and functions as a lubricating mechanism for a portion of the driving mechanism including the interior of boss 233. Oil passageway 33 is connected between an inner chamber of boss 233 in which bushing 29 and bearing 30 are disposed and a fluid pocket located at the outer peripheral portion of both spiral elements 222 and 232. Therefore, a slight part of the compressed fluid in outer fluid pocket, together with the intermixed lubricating oil, flows into the interior of boss 233, due to the pressure difference between the interior of boss 233 and the fluid pocket. The lubricating oil within the interior of boss 233 flows out from the interior through bearing 30 to suction chamber 27. Bearing 30 and the connecting portion between drive pin 132 and bushing 29 are thus lubricated by this lubricating oil.

Figure 2:
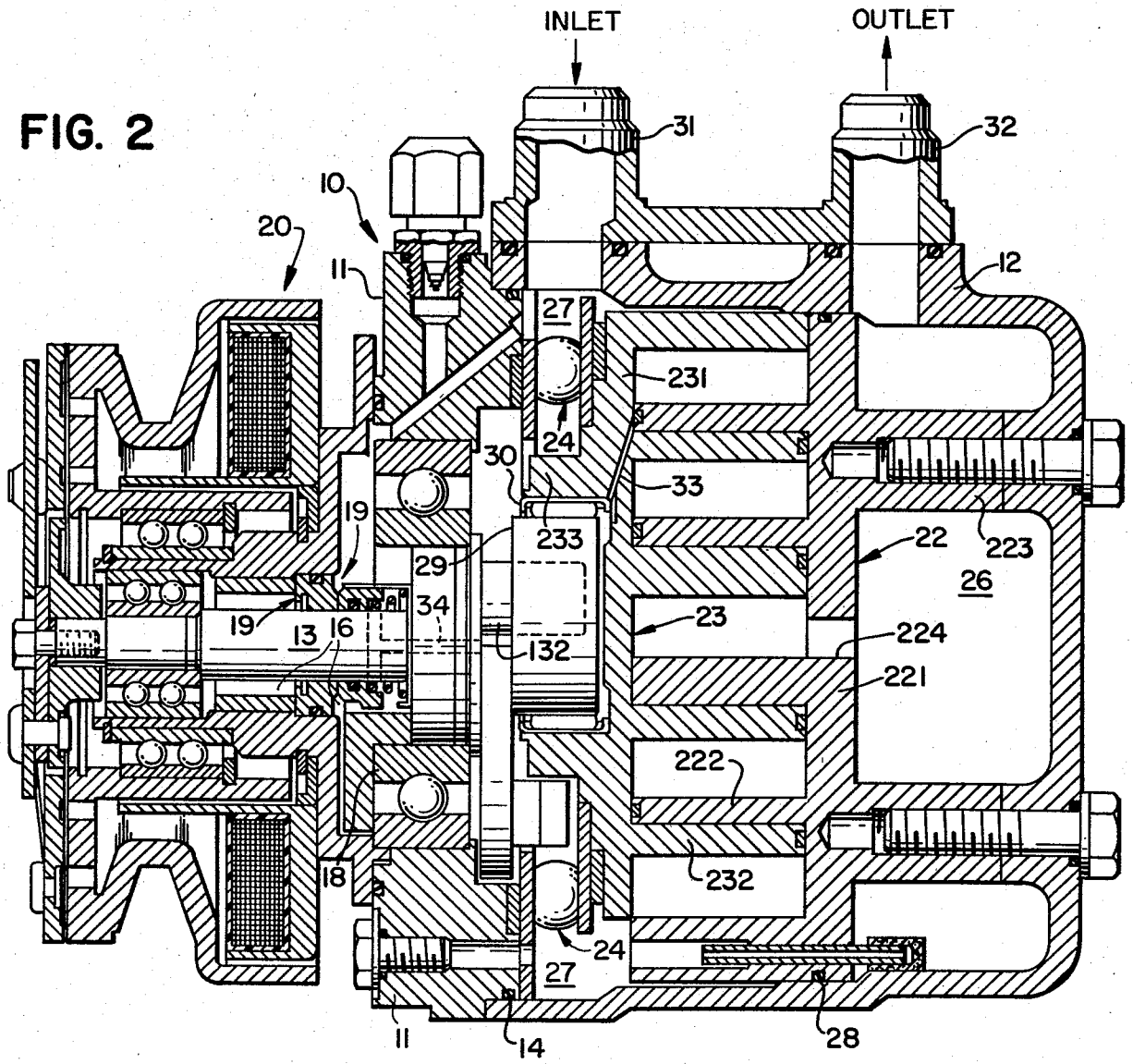
FIG. 2 is a vertical sectional view of a compressor unit according to another embodiment of this invention.

In FIG. 2, another embodiment of this invention is shown which is directed to a modification of the lubricating mechanism. In this embodiment, the lubricating mechanism includes a second oil passageway 34 formed in drive shaft 13 to connect between suction chamber 27 and shaft seal cavity 16. Therefore, a part of the lubricating oil which flows out from the interior of boss 233 flows into shaft seal cavity 16 through second oil passageway 34 and lubricates shaft seal assembly 19. The lubricating oil returns back to suction chamber 26 through bearing 18, and thus also lubricates bearing 18.

This invention has been described in detail in connection with the preferred embodiments, but these are examples only and this invention is not restricted thereto. It will be easily understood by those skilled in the art that other variations and modifications can be easily made within the scope of this invention.

We claim:

1. In a scroll-type fluid displacement apparatus including a housing having a front end plate, a fixed scroll fixedly disposed relative to said housing and having a first circular end plate from which a first wrap extends, an orbiting scroll having a second circular end plate from which a second wrap extends, said first wrap and second wrap interfitting at an angular and radial offset to make a plurality of line contacts to define at least one pair of sealed-off fluid pockets, and a driving device including a drive shaft rotatably supported on said front end plate and operatively connected to said orbiting scroll to effect the orbital motion of said orbiting scroll, a rotation-preventing device for preventing the rotation of said orbiting scroll during its orbital motion whereby the volume of the fluid pockets changes, said driving device including a drive pin projecting at an eccentric location from the inner end of said drive shaft, an annular boss projecting from the side of said second end plate opposite from which said second wrap extends and a bushing rotatably carried in said boss, said drive pin being disposed within an eccentric hole in said bushing to operatively support said orbiting scroll, lubricating means for lubricating at least the interior of said boss, said lubricating means including an oil passageway having an inlet opening at one of said fluid pockets located at the outer peripheral portion of said wraps, an outlet opening at the interior of said boss and a hollow interior extending through said second end plate between said inlet and outlet openings to transfer a slight part of the compressed fluid and intermixed lubricating oil from said last-mentioned fluid pocket to the interior of said boss.

2. The scroll-type fluid displacement apparatus of claim 1 further comprising a shaft seal cavity formed in said front end plate, and said lubricating means including a second oil passageway formed in said drive shaft and connected between the interior of said housing and said shaft seal cavity of said front end plate for lubricating said shaft seal cavity.

3. A scroll-type fluid displacement apparatus comprising:

a housing having a front end plate;

a shaft seal cavity formed in said front end plate;

a fixed scroll fixedly disposed relative to said housing and having a first circular end plate from which a first wrap extends;

an orbiting scroll having a second circular end plate from which a second wrap extends, and said first and second wraps interfitting at an angular and radial offset to make a plurality of line contacts to define at least one pair of sealed-off fluid pockets;

a driving device operatively connected to said orbiting scroll, said driving device including a drive shaft, a drive pin, an annular boss and a bushing, said drive shaft being rotatably supported in said front end plate, said drive pin projecting at an eccentric location from an inner end of said drive shaft, said annular boss axially projecting from said second end plate, said bushing being rotatably carried in said boss, and said drive pin extending into an eccentric hole in said bushing;

a rotation-preventing device disposed between the inner surface of said housing and said second end plate to prevent the rotation of said orbiting scroll; and an oil passageway for lubricating at least the interior of said boss, said oil passageway having an inlet opening at one of said fluid pockets located at the outer peripheral portion of said wraps, an outlet opening at the interior of said boss and a hollow interior extending through said second end plate between said inlet and outlet openings to transfer a slight part of the compressed fluid and intermixed lubricating oil from said last-mentioned fluid pocket to the interior of said boss.

4. The scroll-type fluid displacement apparatus of claim 3 further comprising second oil passageway formed through said drive shaft and connected between said shaft seal cavity and an axial inner end surface of said drive shaft.

* * * * *